US008899152B2

(12) United States Patent
Ramakrishnan

(10) Patent No.: US 8,899,152 B2
(45) Date of Patent: Dec. 2, 2014

(54) FLEXOGRAPHIC PRINTING USING FLEXOGRAPHIC ROLL CONFIGURATIONS

(71) Applicant: Unipixel Displays, Inc., The Woodlands, TX (US)

(72) Inventor: Ed S. Ramakrishnan, The Woodlands, TX (US)

(73) Assignee: Unipixel Displays, Inc., The Woodlands, TX (US)

( * ) Notice: Subject to any disclaimer, the term of this patent is extended or adjusted under 35 U.S.C. 154(b) by 0 days.

(21) Appl. No.: 13/980,288

(22) PCT Filed: Oct. 25, 2012

(86) PCT No.: PCT/US2012/061763

§ 371 (c)(1),
(2), (4) Date: Jul. 17, 2013

(87) PCT Pub. No.: WO2013/063173

PCT Pub. Date: May 2, 2013

(65) Prior Publication Data

US 2014/0053746 A1 Feb. 27, 2014

Related U.S. Application Data

(60) Provisional application No. 61/551,226, filed on Oct. 25, 2011.

(51) Int. Cl.

| | |
|---|---|
| ***B41F 33/00*** | (2006.01) |
| ***B41F 27/00*** | (2006.01) |
| ***B41F 31/02*** | (2006.01) |
| ***B41C 1/02*** | (2006.01) |
| ***B41F 5/24*** | (2006.01) |
| ***B41M 1/04*** | (2006.01) |

(52) U.S. Cl.

CPC ..... *B41F 31/027* (2013.01); *B41C 1/02* (2013.01); *B41F 5/24* (2013.01); *B41M 1/04* (2013.01)

USPC ..... 101/483; 101/383

(58) Field of Classification Search

CPC .. B41F 27/12; B41F 27/1262; B41F 27/1275; B41L 47/04

USPC ..... 101/375, 378, 382.1, 383, 415.1, 483, 101/492

See application file for complete search history.

(56) References Cited

U.S. PATENT DOCUMENTS 1,370,709 A 3/1921 Frank et al.
3,213,790 A * 10/1965 McKay ..... 101/415.1

(Continued)

FOREIGN PATENT DOCUMENTS

| | | | |
|---|---|---|---|
| EP | 2048930 | A1 | 4/2009 |
| JP | 06115238 | A | 4/1994 |
| KR | 1020080075787 | A | 8/2008 |

OTHER PUBLICATIONS

PCT/US2012/061763 International Search Report and Written Opinion dated Feb. 26, 2013 (10 pgs.).

*Primary Examiner* — Ren Yan

(57) ABSTRACT

In a flexographic printing system, the both the process parameters and equipment setup and configuration may play a role in producing the desired printed pattern. One component of the equipment setup is the printer roller assembly which may comprise a roller and a flexoplate as well as tape. The properties of the flexoplate and the tape as well as the relative dimensions of each in the assembly may affect the geometry and quality of the transferred pattern, as well as the ability of the system to produce a pattern on a repeatable, consistent basis.

5 Claims, 8 Drawing Sheets

(56) References Cited

U.S. PATENT DOCUMENTS

| | | | | | |
|---|---|---|---|---|---|
| 3,808,970 | A * | 5/1974 | Delligatti | 101/35 |
| 3,812,780 | A * | 5/1974 | Borelli | 101/216 |
| 5,402,721 | A * | 4/1995 | Schultz | 101/389.1 |
| 5,476,712 | A | 12/1995 | Hartman et al. | |
| 6,312,872 | B1 * | 11/2001 | Murphy et al. | 430/306 |
| 6,655,274 | B2 * | 12/2003 | Satoh et al. | 101/216 |
| 7,207,268 | B2 * | 4/2007 | Brunst | 101/376 |
| 7,237,482 | B2 | 7/2007 | Vest | |
| 7,617,592 | B2 * | 11/2009 | Rayl et al. | 29/611 |
| 2003/0037687 | A1 * | 2/2003 | Aubanel | 101/382.1 |
| 2006/0236886 | A1 * | 10/2006 | Leenders et al. | 101/492 |

* cited by examiner

FIG. 6(a)
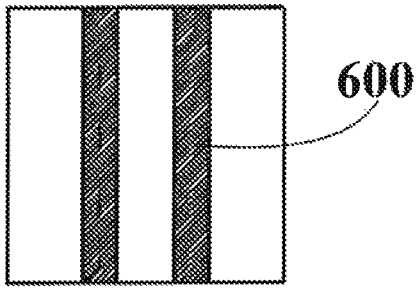
FIG. 6(b)
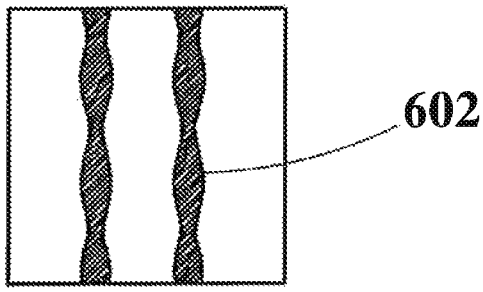
FIG. 6(c)
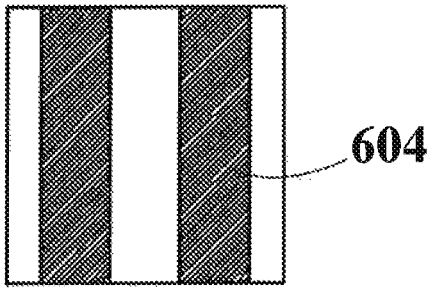
FIG. 6

FLEXOGRAPHIC PRINTING USING FLEXOGRAPHIC ROLL CONFIGURATIONS

CROSS-REFERENCE TO RELATED APPLICATION

This application is a national stage of and claims priority under 35 U.S.C. §371 to International Patent Application Ser. No. PCT/US2012/061763, filed on Oct. 25, 2012, entitled "FLEXOGRAPHIC PRINTING USING FLEXOGRAPHIC PRINTING ROLL CONFIGURATIONS" by Ed S. RAMAKRISHNAN, which claims the benefit of and priority under 35 U.S.C. §119 to U.S. Provisional Patent Application No. 61/551,226, filed on Oct. 25, 2011, entitled "CUSTOMIZED EMBOSSING METHOD FOR PRINTING PATTERNS ONTO A SUBSTRATE WHEREIN SPECIFIC TYPE OF TAPES CONNECT THE FLEXOPLATE TO THE PRINTING CYLINDER" by Ed S. RAMAKRISHNAN, et al., both of which are hereby incorporated herein by reference in their entirety for all purposes.

BACKGROUND

Flexographic printing involves the assembly of a flexoplate to a roller that is part of a roll-to-roll handling system. Printing microscopic patterns by flexographic printing imay be challenging, especially if those patterns involve intricate geometries. The assembly of the flexographic printing system can be used to control the printing of the microscopic patterns. This disclosure relates generally to the printing of high resolution conducting patterns, specifically to process parameters involving mounting tape.

SUMMARY

In an embodiment, an apparatus for flexoprinting patterns on a substrate comprising: a printer roller, comprising a pair of end portions defining a recess between the portions, the recess having a depth; and a tape disposed in the recess, the thickness of the tape having the same depth as the recess, and a flexoplate. The embodiment further comprising wherein the tape has a uniform thickness; wherein the tape is disposed in the uniform circumferential recess around at least part of the circumference of the roller; wherein the flexoplate has a pattern on a surface opposite the surface disposed on the tape, and wherein the pattern comprises a plurality of lines; wherein the tape hardness is about 20 on the Shore A scale; and wherein the tape thickness is between 300 μm-500 μm and is +/−10% of the recess depth.

In an embodiment, a method of flexographically printing high resolution conductive patterns comprising: disposing a flexoplate in a recess of a printer roller by adhering the flexoplate to the printer roller, wherein adhering the flexoplate to the printer roller comprises disposing adhesive on at least one of the flexoplate or the printer roller, and wherein the flexoplate has a pattern comprising a plurality of lines on a first side of the flexoplate. The embodiment further comprising printing, using a high resolution pattern printing (HRP) module, a high resolution pattern on at least one side of the substrate, wherein the HRP module comprises a printer roller, an ink source, and an anilox roll; and plating the printed pattern to form a high resolution conductive pattern.

In an alternate embodiment, a method of manufacturing high resolution conductive patterns comprising: disposing, on a printing roller, a flexoplate, wherein the flexoplate has a pattern on a first side; and disposing, on an unwind roller, wherein a substrate is disposed on the unwind roller. The embodiment further comprising printing, using a high resolution pattern printing (HRP) module, a microscopic pattern comprising a plurality of lines; wherein the HRP module comprises a tape, a printer roller comprising a circumferential recess, and a flexoplate; wherein the tape has a thickness is between 250 μm.-750 μm, and a density from 10-25 lb/in$^2$; wherein the tape is disposed in the circumferential recess on top of the tape; and wherein the thickness of the tape is more than 10% greater than the depth of the circumferential recess.

BRIEF DESCRIPTION OF THE DRAWINGS

For a detailed description of exemplary embodiments of the invention, reference will now be made to the accompanying drawings in which:

FIGS. 6A-C are embodiments of High Resolution Conducting Patterns (HRCP) printed using various roller configurations.

DETAILED DESCRIPTION

Figure 1:
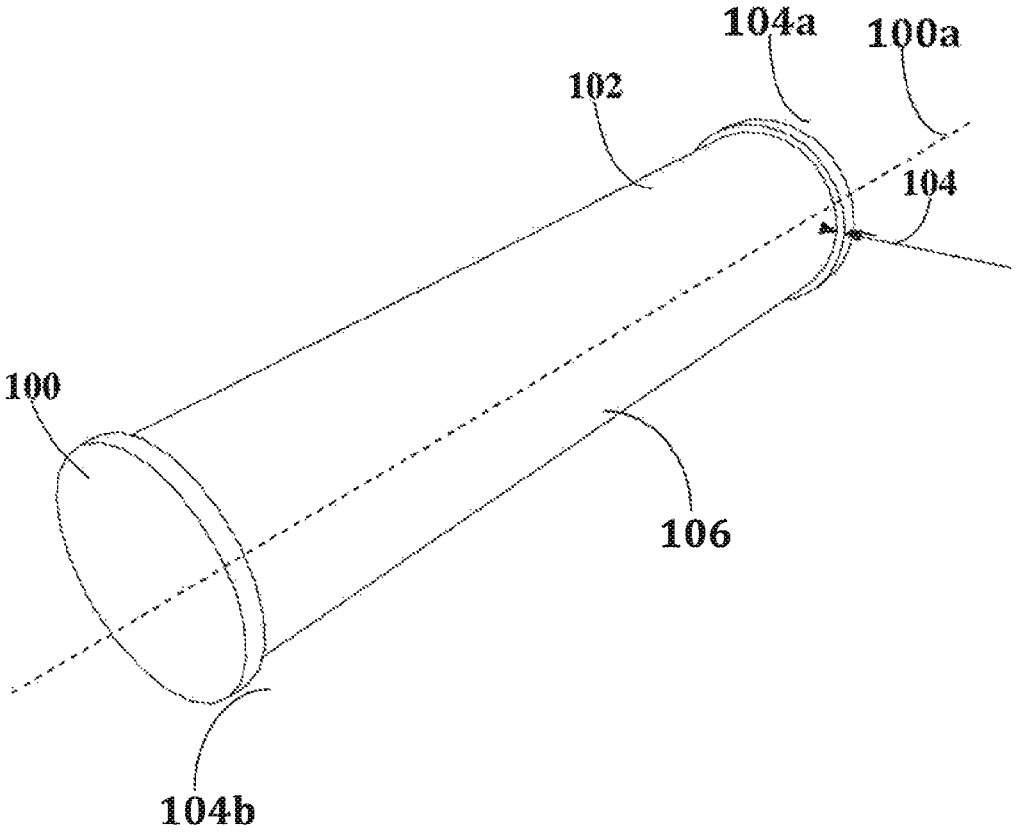
FIG. 1 is an isometric view of an embodiment of roller with a recess.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Flexography is a form of a rotary web letterpress where relief plates are mounted on to a printing cylinder, for example, with double-sided adhesive. These relief plates, which may also be referred to as a master plate or a flexoplate, may be used in conjunction with fast drying, low viscosity solvent, and ink fed from anilox or other two roller inking systems. The anilox roll may be a cylinder used to provide a measured amount of ink to a printing plate. The ink may be, for example, water-based or ultraviolet (UV)-curable inks. in one example, a first roller transfers ink from an ink pan or a metering system to a meter roller or anilox roll. The ink is metered to a uniform thickness when it is transferred from the anilox roller to a plate cylinder. When the substrate moves through the roll-to-roll handling system from the plate cylinder to the impression cylinder, the impression cylinder applies pressure to the plate cylinder which transfers the image on to the relief plate to the substrate. In some embodiments, there may be a fountain roller instead of the plate cylinder and a doctor blade may be used to improve the distribution of ink across the roller.

Flexographic plates may be made from, for example, plastic, rubber, or a photopolymer which may also be referred to as a UV-sensitive polymer. The plates may be made by laser engraving, photomechanical, or photochemical methods. The plates may be purchased or made in accordance with any known method. The preferred flexographic process may be set up as a stack type where one or more stacks of printing stations are arranged vertically on each side of the press frame and each stack has its own plate cylinder which prints using one type of ink and the setup may allow for printing on one or both sides of a substrate. In another embodiment, a central impression cylinder may be used which uses a single impression cylinder mounted in the press frame. As the substrate enters the press, it is in contact with the impression cylinder and the appropriate pattern is printed. Alternatively, an inline flexographic printing process may be utilized in which the printing stations are arranged in a horizontal line and are driven by a common line shaft. In this example, the printing stations may be coupled to curing stations, cutters, folders, or other post-printing processing equipment. Other configurations of the flexo-graphic process may be utilized as well.

In an embodiment, flexo plate sleeves may be used, for example, in an in-the-round (ITR) imaging process. In an ITR process, the photopolymer plate material is processed on a sleeve that will be loaded on to the press, in contrast with the method discussed above where a flat plate may be mounted to a printing cylinder, which may also be referred to as a conventional plate cylinder. The flexo-sleeve may be a continuous sleeve of a photopolymer with a laser ablation mask coating disposed on a surface. In another example, individual pieces of photopolymer may be mounted on a base sleeve with tape and then imaged and processed in the same manner as the sleeve with the laser ablation mask discussed above. Flexo-sleeves may be used in several ways, for example, as carrier rolls for imaged, flat, plates mounted on the surface of the carrier rolls, or as sleeve surfaces that have been directly engraved (in-the-round) with an image. In the example where a sleeve acts solely as a carrier role, printing plates with engraved images may be mounted to the sleeves, which are then installed into the print stations on cylinders. These pre-mounted plates may reduce changeover time since the sleeves can be stored with the plates already mounted to the sleeves. Sleeves are made from various materials, including thermoplastic composites, thermoset composites, and nickel, and may or may not be reinforced with fiber to resist cracking and splitting. Long-run, reusable sleeves that incorporate a foam or cushion base are used for very high-quality printing. In some embodiments, disposable "thin" sleeves, without foam or cushioning, may be used. The flexoplate roller configuration plays a role in this process as described below. A plurality of roller configurations are described below, wherein a roller configuration is the combination of at least a roller and a flexoplate, preferably wherein the flexoplate FIG. 1 is an isometric view of a roller 100. The roller 100 includes body 102 and has a first end 104*a* and a second end 104*b*. The term "roller" may refer to any cylindrical object which may revolve around an axis 100*a* located through the center of the length of the body 102 of the cylinder. In one example, the roller 100 is a solid piece that is cast, forged, machined, or otherwise thermo-mechanically processed to form a recess 106 which extends circumferentially around the body 102 from the first end 104*a* to the second end 104*b*. In an alternate embodiment (not pictured) the roller 100 is an assembly of two endcaps which may be in the same locations as ends 104*a* and 104*b* The term "recess" may refer to an empty region in a solid, hollow, or composite object. The recess 106 has a depth 108, wherein the depth 108 may be the measurement of how much each raised end is raised from the body 102 of the roller 100, in accordance with various embodiments of the disclosure. In an embodiment, the recess 106 depth 108 is preferably uniform and extends around the circumference of the body 102.

Figure 2:
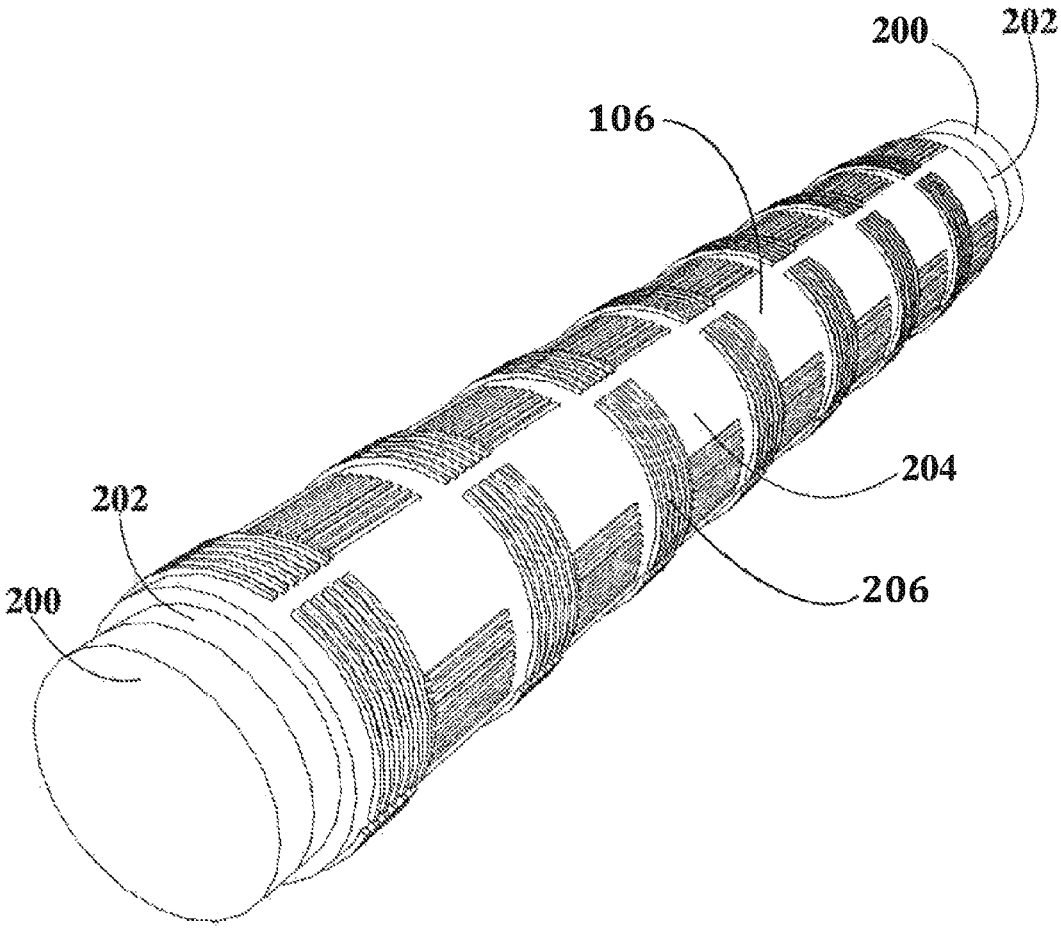
FIG. 2 is an isometric view of an assembled roller configuration.

FIG. 2 is an isometric view of an embodiment of an assembled roller configuration. Roller configuration 200 may have mounting tape 202 mounted circumferentially around the body 102 of roller 200 in the recess 106. The tape 202 described herein may refer to a strip of plastic or other polymer with adhesive on at least one side that may be used to mount a flexoplate 204 on a roller configuration 200. In an embodiment, flexoplate 204 may be mounted on top of tape 202. The term "flexoplate" may refer to a backed, patterned photopolymer used to apply ink on a substrate and may be used interchangeably with the term "master plate." The flexoplate 204 may have a pattern comprising a plurality of lines to be printed on a substrate. The flexoplate may be used to transfer ink on to a substrate (not pictured). Ink transfer may refer to the ability of a flexographic plate to apply an amount of ink onto a substrate, for example, because the ink is transferred from a pan, a feed line, or a feeder roll on to the roll and then on to a substrate. In various embodiments of the disclosure, tape 202 can have a plurality of thicknesses and hardnesses and may have a density from 10-25 lb/in$^2$. The thicknesses may be from 200 μm-750 μm, and, in an embodiment, the thickness is preferably from 300 μm-500 μm (approximately 0.015"-0.020"). The tape may also have a compression deflection which is used to quantify the % deformation in the material when a compressive load is applied, the measure may be used to define the "softness" or "hardness" of a foam such as the foam that comprises the tape. The compressive deflection may range from 5%-50% with the tapes on the lower end (<10%) referred to as "soft" tapes and the tapes on the higher end (>25%) referred to as "hard" tapes. The values may be 10%, 15%, and 25% for the compressibility deflection. The combination of tape or tapes with the appropriate compressive deflection with a plate with a particular hardness may result in uniform printing of a desired geometric pattern. The hardness of the tape may be, for example, between 10-80 on the Shore A scale, where the appropriate hardness may be a function of thickness of the tape. A durometer, an apparatus that measures a material's hardness in at least one scale, may be used to measure the hardness of the tape. The hardness scales used may be, for example, the Shore, Brinell, Mohs, Knoop, Vickers, and Rockwell scales. The tape 202 is disposed in the recess 106 and the flexoplate 204 may be disposed on top of the tape 202. In various embodiments, the tape 202 used may have a thickness less than, equal to, or greater than the recess 106. These embodiments are further discussed in FIGS. 4A-4C below. The flexoplate 204 may comprise a pattern 206 of a plurality of lines. In an embodiment, a 0.015" thick tape is used in combination with 0.045" flexoplates with a Shore A hardness value of 73. In this example, the relative width is as follows: 45±5 μm, 25±5 μm, and 8±2 μm respectively for tapes with 25% compressibility at 5 psi, 60 psi and 22 psi. This may result in very low and very high compression deflection results in wider lines than a matched tape where the tape has a hardness close to or near the hardness of the flexoplate. For at least the flexoplates with a Shore A hardness from 50-120, the embossed (printed) line width becomes closer to the design (flexoplate) line width the closer the match between the backing tape hardness and the flexoplate hardness.

Figure 3:
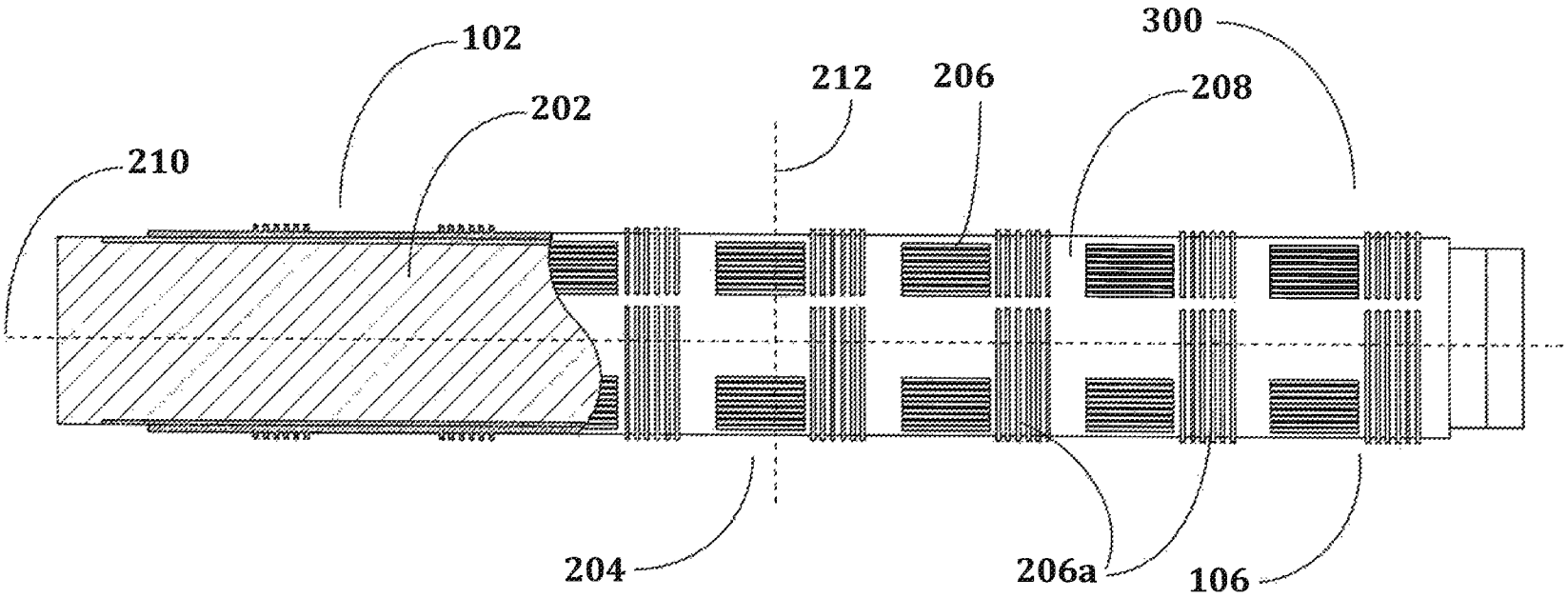
FIG. 3 is a cross-sectional view of an assembled roller configuration.

FIG. 3 is an embodiment of a roller configuration. In roller configuration 300, tape 202 may be disposed along all or part of the length of the recess 106 along body 102. In an embodiment, flexoplate 204 may be disposed on top of tape 202 along all or part of the body 102 of roller 300.

In an embodiment, flexoplate 204 may have a first side 208 that has a raised pattern 206 which can also be seen in FIG. 2. Pattern 206 may comprise a plurality of lines 206*a* that are preferably oriented in multiple directions along the X-axis 210 and Y-axis 212 planes of the flexoplate 204.

Figure 4A:
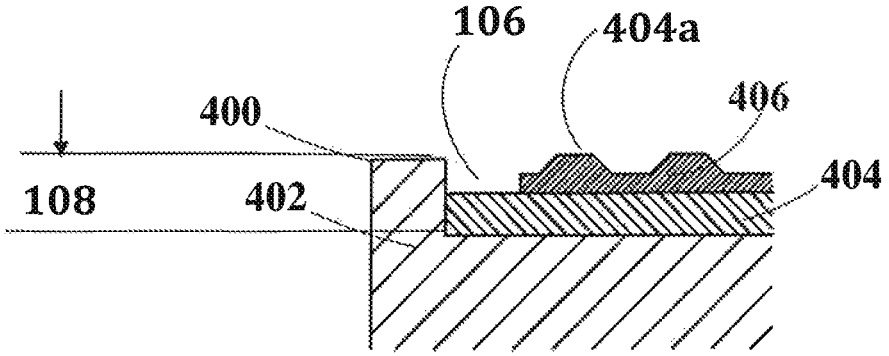
FIGS. 4A-C are illustrations of cross-sections of various embodiments of roller configurations.
Figure 4B:
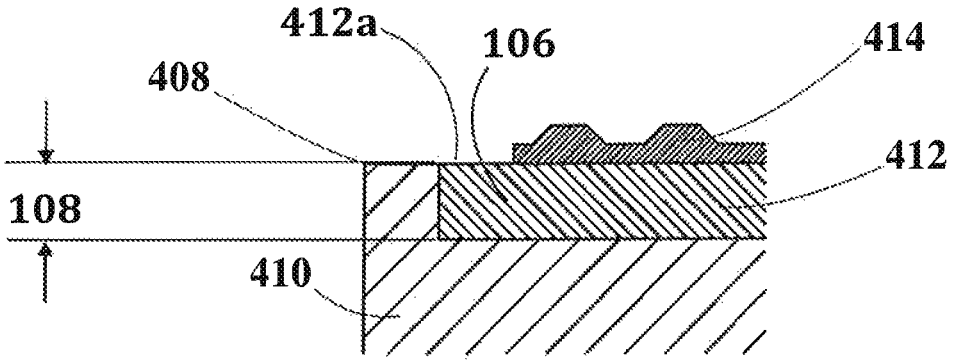
Figure 4C:
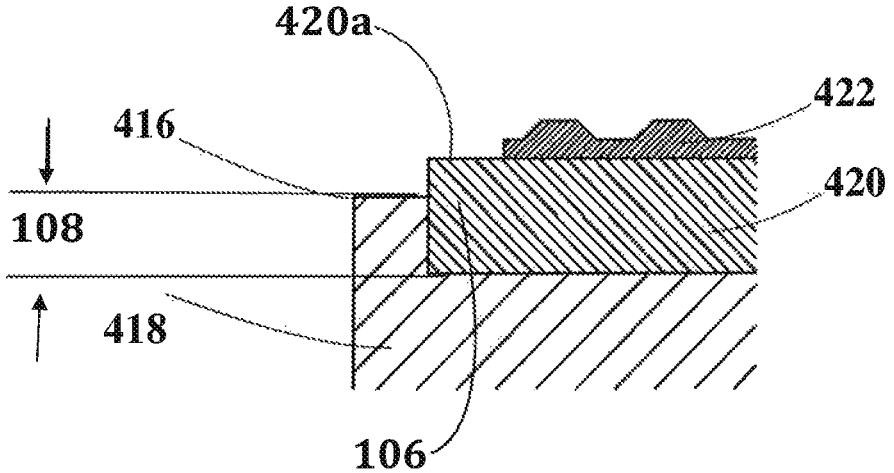

FIGS. 4A-4C are illustrations of embodiments of configured printing roller rollers. Printing rollers can be configured in various ways wherein the roller dimensions, tape hardness and thickness, as well as choice of flexoplate can, alone or in combination, may effect the quality of the printed pattern. In some embodiments, the printed pattern comprises lines that are printed with an ink containing at least a catalyst that promotes plating the pattern at a later step in the process. As such, the printing process may be controlled as to produce uniform patterns in a repeatable manner. A uniform pattern is one in which the thickness and edge shape of the lines are controllable and made through a repeatable process. In some embodiments, this means producing straight lines with clean edges as depicted and discussed below in FIGS. 6A and 6C. In an alternate embodiment (not pictured) the thickness of the line may vary in an alternating fashion or may taper in one or both directions on one or both sides of the feature.

FIG. 4A is an embodiment of printing roller configuration 400 with roller 402 and recess 106 comprising a depth 108. In an embodiment, FIG. 4A may also comprise tape 404, and flexoplate 406. The tape 404 may be disposed in the recess 106. In FIG. 4A, the tape thickness of tape 404 may be less than the depth of the recess depth 108. The thickness of tape 404 may be such that when the tape 404 is disposed in the recess 106 and the flexoplate 406 is disposed on top of the tape 404, the top of the protrusions 404*a*, which may also be referred to as patterned lines, are flush with the top of recess 106 and the tape is more than 10% below the top of the recess depth 108. The cross-section of the ridges 404*a* may be, for example, rectangular, square, trapezoidal, semi-circle, or other geometry, and a flexoplate may contain a pattern of lines with one or more cross-sectional geometries.

FIG. 4B is an alternate embodiment of a configuration of a printing roller. In FIG. 4B, printing roller 408 with configuration 410 has a recess 106 comprising a depth 108. FIG. 4B may also comprise tape 412, and flexoplate 414. In an embodiment, the tape thickness of the tape 412 may be the same as or similar to the depth 108 of recess 106. In an embodiment, the tape thickness is within +/−10% of the recess depth. The thickness of the tape 412 is such that when the tape is disposed in the recess 106 and the flexoplate illustrated by flexoplate 414 is disposed on top of the tape 412, the top 412*a* of the tape 412 is flush with the top of recess 106 and the tops of protrusions of the flexoplate 414 extend above the top of recess 106.

FIG. 4C is an alternate embodiment of a configuration of a printing roller. In FIG. 4C, printing roller 416 with configuration 418 that has a recess 106 comprising a depth 108. In an embodiment, FIG. 4C may also comprise a tape 420, and a flexoplate 422. In an embodiment, the tape thickness of the tape 420 is greater than the depth 108 of recess 106 by more than 10% such that the top 420*a* of the tape 422 is above the top of recess 106, and, therefore, the flexoplate 422 protrude beyond the outer edge of the roller. In an embodiment, this type of configuration 418 may result in excessive contact pressure during ink transfer which may result in the ability to control the transfer of ink to produce more uniform, thicker lines than in the configurations in FIGS. 4A and 4B. Examples of patterns produced by FIGS. 4A-4C are shown in FIGS. 6A-6C, wherein 6A illustrates an example of a pattern printed by configuration 4B, 6B illustrates an example of a pattern printed by configuration 4A, and 6C illustrates an example of a pattern printed by configuration 4C.

Figure 5:
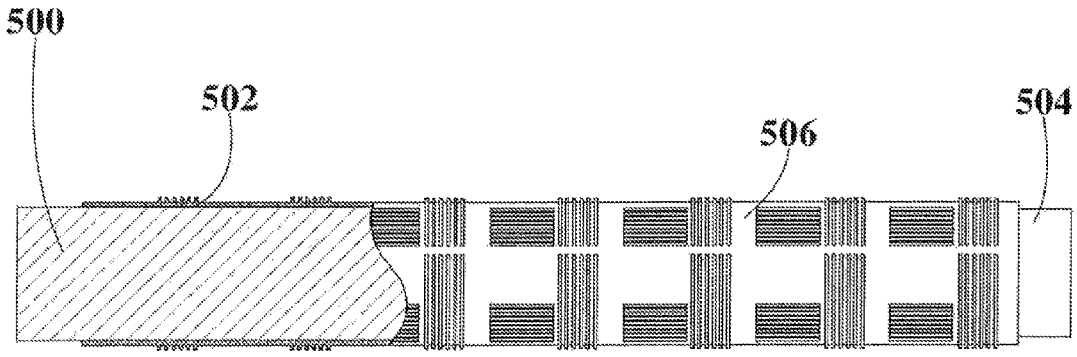
FIG. 5 is an illustration embodiment of a cross-section of a tapeless roller configuration.

FIG. 5 is an illustration of a cross-section of an alternate embodiment of a printing roller configuration. In this embodiment, roller configuration 500 comprises a roller 504 and a flexoplate that may also be referred to as a patterned flexoplate 502 that has a plurality of lines in a pattern 506 on one side. In this embodiment, the flexoplate 502 is disposed on the roller 504. In one example, the flexoplate 502 may be disposed on the roller 504 without the use of tape as in FIGS. 2, 3, and 4A-4C. In this example, the flexoplate 502 may have an adhesive (not pictured) on the side of the flexoplate 502 opposite to the pattern 506, adjacent roller 504. In another example, an adhesive spray, liquid, solid, or powder may be applied to roller 504. This applied spray, liquid, solid, or powder may be applied at room temperature and may in some embodiments require thermal activation or may react with the side opposite the pattern 506 in order to adhere to the roller 504.

FIGS. 6A-6C are embodiments of printed High Resolution Conducting Patterns (HRCP) based on various embodiments of the disclosure. An HRCP may refer to the pattern printed as disclosed herein or to the plated pattern because, preferably, the plated pattern should be about the same dimensions as the printed pattern. In alternate embodiments where some variation may occur between printing and plating, the size of the printed lines may be adjusted accordingly. The printed lines may also be less than 50 μm wide and the tolerance of these lines may be controlled using in part the roller configurations discussed in FIGS. 4A-4C as well as the processing parameters of the printing process. An HRCP may be any conductive material patterned on a non-conductive substrate where the conductive material is less than 50 μm wide along the printing plane of the substrate. The conductive material may be copper (Cu), nickel, (Ni), silver (Ag), gold (Au), palladium (Pd), and alloys or combinations thereof. FIG. 6A is an embodiment of a uniform HRCP 600. Pattern uniformity may refer to the lack of variation in width of a HRCP along the printing plane of the substrate; in addition, it may refer to being able to control the variation in the width of an HRCP. Pattern uniformity may become increasingly difficult to achieve as the width of the pattern and individual features in the pattern decrease in size. In addition, pattern uniformity may be difficult to maintain with increased complexity of the features.

FIG. 6B is an embodiment of a non-uniform HRCP 602. A non-uniform HRCP 602 may result, for example, from roller configurations that comprise a tape with a lower tape hardness, where a lower tape hardness is defined as a hardness <20 on the Shore A scale, or from roller configurations where the tape thickness is less than the recess as illustrated in FIG. 4A.

FIG. 6C is an embodiment of a widened HRCP 604. Widened HRCP 604 may result from embodiments with higher tape hardnesses, where a higher tape hardness is devined as a hardness >70 on the Shore A scale. In an embodiment, widened HRCP 604 may result from a tape thickness greater than the recess 106 as illustrated in FIG. 4C.

Figure 7:
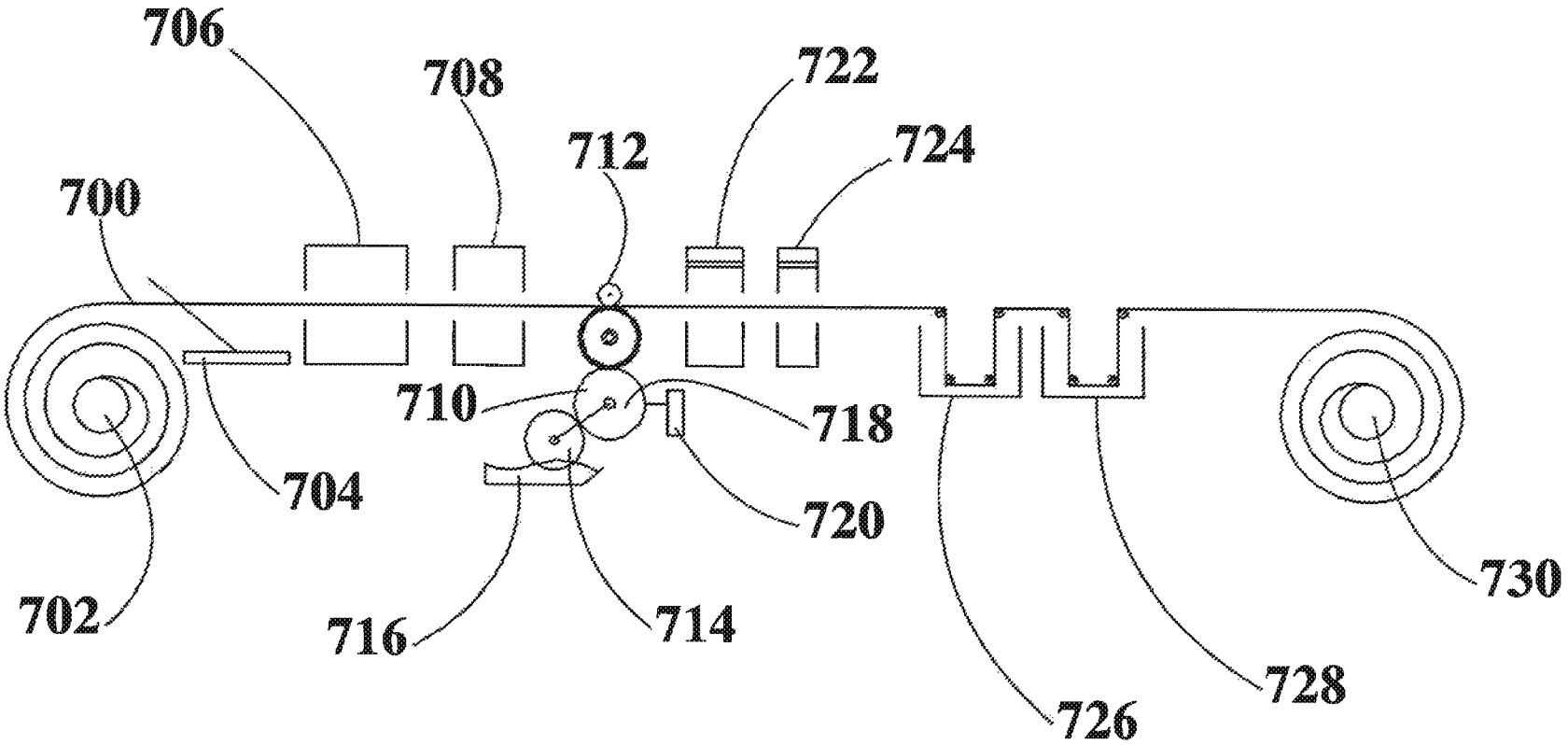
FIG. 7 is an embodiment of a system for manufacturing HRCPs.
Figure 8:
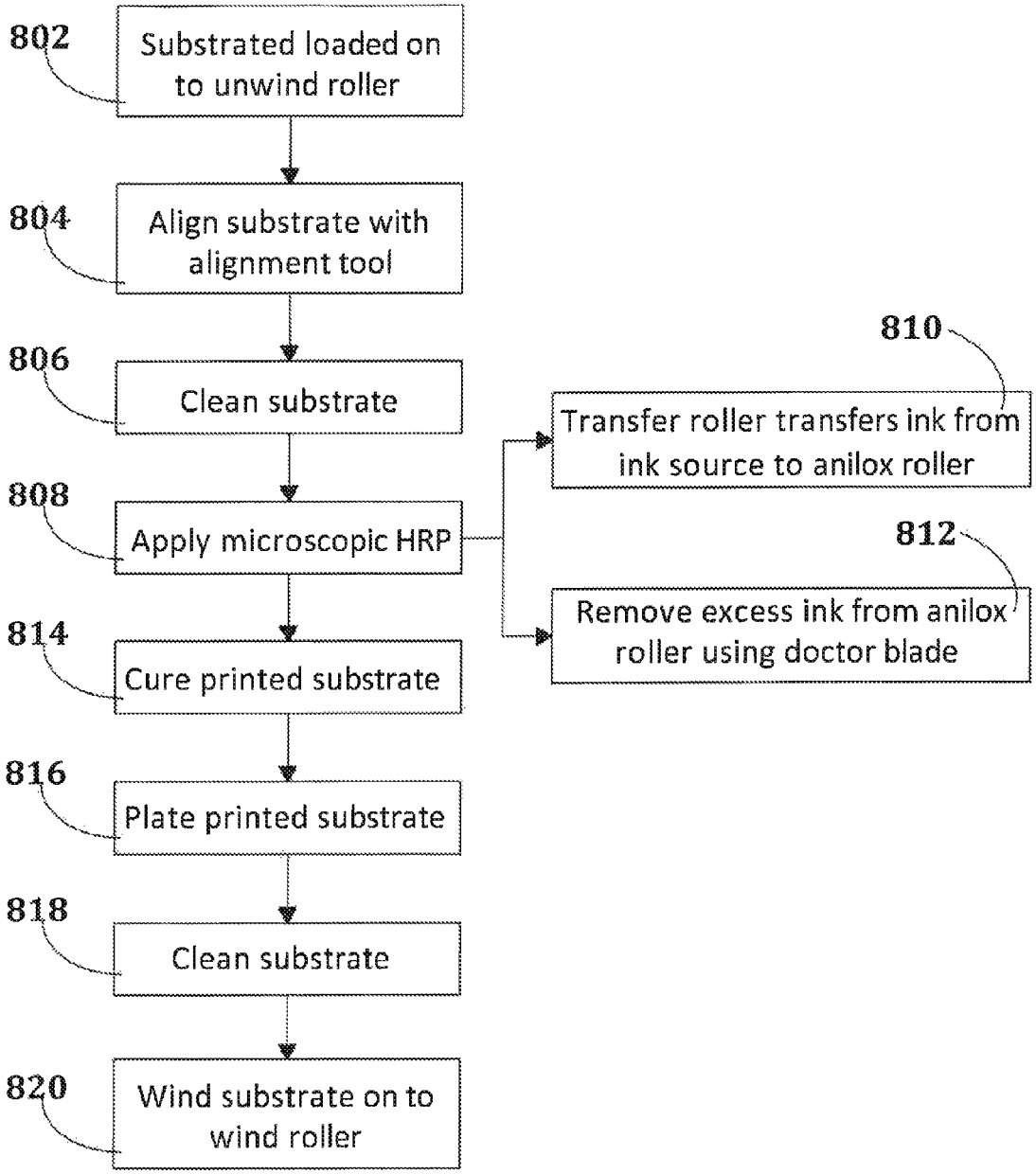
FIG. 8 is an embodiment of a method for manufacturing HRCPs.

FIG. 7 is an embodiment of a system for manufacturing high resolution conductive patterns. Substrate 700 is disposed on unwind roller 702. The substrate 700 may be polyethylene terephthalate (PET), polymethylmethacrylate (acrylic) PMMA, paper, or glass. In some embodiments, substrate 700 may be aligned using alignment apparatus 704 after it is disposed on unwind roller 702 before it may be processed at first cleaning station 706 and second cleaning station 708. In some embodiments, second cleaning station 708, a high resolution pattern (HRP), not shown, may be applied on substrate 700 through printing roller 710, whose contact pressure with substrate 700 is controlled through pressure roller 712. The printing roller may be configured as discussed above with respect to FIGS. 4B or 4C. An HRP may be any non-conductive material patterned on either a conductive or non-conductive substrate where the material may be less than 50 ρm wide along the printing plane of the substrate. To apply the HRP, transfer roller 714 is used to transfer ink from ink source 716 to anilox roll 718. An anilox roll 718 may be any roller with a recess pattern on its surface that may be used to transfer ink onto a flexoplate. In an embodiment, excess ink on anilox roll 718 may be removed by doctor blade 720. Once the HRP has been applied, it may be cured by curing stations 722 and 724. Curing is the act of applying radiation (i.e. ultraviolet light) or heat to change at least one physical or chemical property of a material. In some embodiments, the HRP may then undergo plating at plating station 726 to form a HRCP, not shown, which is then rinsed at rinse station 728 before substrate 700 is wound on to wind roller 730. In one example of a printing roller configuration, FIG. 8 is an embodiment of a printing method. A substrate is loaded on to an unwind roller at loading station 802. In an embodiment, the substrate may be aligned using an alignment tool 804. The substrate may go through at least one cleaning station 806. The substrate may have a high resolution pattern (HRP), not shown, may be applied by a printer roller 808. In an embodiment, such as illustrated in FIG. 2, the printer roller 200 comprises a flexoplate 204 comprising the microscopic pattern to be printed on the substrate and tape 202 that adheres the flexoplate 204 to the roller 200. In an embodiment, the roller 200 comprises a recess 106 and the tape 204 is flush with the top of the recess 106 as illustrated in FIG. 4B. In an alternate embodiment, the roller tape 204 is thicker than the recesses 106 as illustrated in FIG. 4C.

Turning back to FIG. 8, during ink transfer 810, a transfer roller may transfer ink from an ink source to an anilox roller and excess ink may be removed from the anilox roller using a doctor blade at wipe station 812. The substrate may be cured at curing station 814 where at least one of radiation or heat may be applied to the substrate. The printed substrate is plated plating station 816 wherein conductive material may be formed or deposited on the printed microstructure pattern applied during ink transfer 810. The substrate may be cleaned after plating at plating station 818 and then wound on to a wind roller at block 820. In this embodiment, each component may be printed, cured, and plated in series or in parallel. In an alternate embodiment, both patterns may be printed on both sides of a single substrate, cured, and plated simultaneously.

The above embodiments should not be construed as limitations on the scope of the disclosure, but as exemplifications of the presently preferred embodiments thereof. Many other ramifications and variations are possible within the teachings of the disclosure. For example, different inks suitable for printing high resolution conducting patterns may require different conditions to be able to form the high resolution conducting patterns and the variables may have to be varied accordingly. Additionally, there may be a plurality of options in the rollers, tapes, and flexoplates commercially available, and as such there may be other variables dependent on the properties of the materials procured for fabrication that may alter the values of the variable controlled herein. Note also that the manufacturing method employed may be varied, and may employ a plurality of printing processes that may each require a different tape to be applied. Other methods for the manufacture of HRCPs may also be used, including methods in which the ink applied during the printing is the conducting material, methods in which plating is not required, and methods in which there are additional steps before the pattern is conducting. Furthermore, the variables controlled in the process herein may be less critical in the printing of HRCPs with wider features compared to processes in which narrower features are desired. The time required to achieve the requirements in the printing process to manufacture HRCPs may also be one of the variables controlled through the conditions related to the mounting tape as described herein. It is also of note that the methods described herein may be of use in the printing of non-conducting materials, where similar printing resolutions and uniformity may be of use, including but not limiting itself to the printing of graphical material.

While the above description contains many specificities, these should not be construed as limitations on the scope of the invention, but as exemplifications of the presently preferred embodiments thereof. Many other ramifications and variations are possible within the teachings herein. For example, the methods for curing the flexoplates may be varied with the equipment used in the curing. Additionally, a number of different materials may be used as the photopolymer component of the flexoblanks, and the flexoblanks used may vary depending on the resolution required when printing patterns or may also vary according the other conditions inherent to the manufacturing process they may be used with, including the ink composition, contact pressure, ambient conditions, amongst others. Furthermore, the spacing utilized when patterning the flexoblanks may depend on numerous factors in addition to the required valley depth, and as such the performance of the flexoplates will also be tied to the factors. Note also that the above examples may be of great use in the printing of HRPs with patterns less than 10 microns wide.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method of flexographically manufacturing high resolution patterns comprising:

disposing a flexoplate in a uniform circumferential recess of a printer roller by adhering the flexoplate to the printer roller, wherein the flexoplate has a pattern comprising a plurality of lines on a first side of the flexoplate, and wherein adhering the flexoplate to the printer roller comprises disposing an adhesive in the uniform circumferential recess so that the top of the adhesive is flush with the top of the recess and disposing a second side of the flexoplate on the adhesive, printing, using a high resolution pattern printing (HRP) module, a high resolution pattern on at least one side of a substrate, wherein the HRP module comprises the printer roller, an ink source, and an anilox roll; and plating the printed pattern to form a high resolution conductive pattern.

2. The method of claim 1, the adhesive comprises one of an adhesive spray, liquid, gel, or powder.

3. The method of claim 1, wherein a plurality of printer rollers are used to print the HRP.

4. The method of claim 3, wherein each of the plurality of rollers comprises at least a part of the pattern.

5. The method of claim 1, wherein plating comprises an electroless plating that forms a high resolution high resolution conductive pattern (HRCP) using conductive material on top of the printed high resolution pattern.

* * * * *